US007594836B2

(12) United States Patent
Kristensen et al.

(10) Patent No.: US 7,594,836 B2
(45) Date of Patent: Sep. 29, 2009

(54) FLOATING STRUCTURE

(75) Inventors: Per Herbert Kristensen, Rykkinn (NO); Ida Husem, Jar (NO); Erik Pettersen, Tranby (NO); Tor Skogan, Jar (NO)

(73) Assignee: Moss Maritime AS, Lysaker (NO)

( * ) Notice: Subject to any disclaimer, the term of this patent is extended or adjusted under 35 U.S.C. 154(b) by 0 days.

(21) Appl. No.: 10/591,859

(22) PCT Filed: Mar. 2, 2005

(86) PCT No.: PCT/NO2005/000074

§ 371 (c)(1),
(2), (4) Date: Dec. 8, 2006

(87) PCT Pub. No.: WO2005/085059

PCT Pub. Date: Sep. 15, 2005

(65) Prior Publication Data

US 2007/0190870 A1 Aug. 16, 2007

(30) Foreign Application Priority Data

Mar. 10, 2004 (NO) ..... 20041019

(51) Int. Cl.
*B63B 22/02* (2006.01)

(52) U.S. Cl. ..... 441/5

(58) Field of Classification Search ..... 441/3–5
See application file for complete search history.

(56) References Cited

U.S. PATENT DOCUMENTS 4,886,398 A * 12/1989 Sparks ..... 405/224
2002/0067956 A1 6/2002 Cottrell

FOREIGN PATENT DOCUMENTS

GB 1 533 973 11/1978
GB 2147549 A 5/1985

OTHER PUBLICATIONS

Utdrag fra Field Development Concepts of the World), side 96, Nov. 13, 2000.

* cited by examiner

*Primary Examiner*—Stephen Avila
(74) *Attorney, Agent, or Firm*—Birch, Stewart, Kolasch & Birch, LLP

(57) ABSTRACT

The present invention relates to a floating loading buoy (1) comprising a surface element (2), columns (3) connecting the surface element (2) to a submerged pontoon element (4), mooring devices (5) for securing the loading buoy (1) to the seabed (6), at least one attachment point (7) for transfer pipelines (8) from a production/processing/storage unit (9) to the loading buoy (1), mooring and transfer devices (10) for transferring fluid from the loading buoy (1) to a loading/unloading vessel (11). The surface element (2) is arranged floating in the water plane surface (12) and has a substantially rounded cross section in a substantially horizontal plane and a draught in the body of water, the columns (3) extend from the surface element (2) down to the pontoon element (4), which in a substantially horizontal plane has a substantially rounded external perimeter and a draught in the body of water. The proportion of the volume of the pontoon element (4) divided by the waterline area of the surface element (2) is in the range 4-7 m, and preferably approximately 6 m, and the draught of the surface element (2) divided by the draught of the pontoon element (4) is in the range 0.31-0.43 and where the vertical mooring rigidity for the loading buoy (1) is over 50% of the waterline rigidity for the loading buoy (1).

11 Claims, 4 Drawing Sheets

FLOATING STRUCTURE

The present invention relates to a floating structure comprising a surface element arranged in the surface of the water and columns connecting the surface element to a submerged pontoon element. The structure is anchored to the seabed by a relatively taut mooring system and transfer pipelines for oil or gas extend to and from the floating structure. According to preferred embodiments of the invention, the floating structure is in the form of a loading buoy or a wellhead platform.

Floating units are often chosen for use in connection with offshore production alternatively storage and/or loading and unloading of fluid. It may be a case of a floating production unit connected to the subsurface wells with risers, a floating interim storage unit or alternatively floating loading buoys. For all of these units rigid risers are often employed, suspended in complete or partial catenaries for transfer of fluid to or from the unit.

In many field developments a solution is chosen for example with a fixed or floating production and storage unit that is connected to sub-sea wells via, for example, flexible or rigid risers. In the case of a floating production platform with rigid risers where there is a wish to have the wellheads mounted on the platform, the platform should have a motion characteristic that gives the least possible motion of the floating unit, thus enabling any compensating devices to be made as small as possible or to be eliminated. To have the wellheads mounted above the surface of the water is easier since it provides a dry system, the disadvantage normally being that relatively extensive compensating devices are required for the platform's movement in the body of water. For a floating production platform of this kind there will often also be provided export pipelines to a storage unit and/or to a loading/unloading system, where these export pipelines are often rigid steel pipes, so-called Steel Catenary Risers (SCR), which normally, at least for part of their length, are in the form of catenaries. These SCR's are subject to fatigue as a result of the floating platform's motion.

Where loading/unloading vessels are employed for transport of the fluid, in order for a loading/unloading system to have the greatest possible uptime, the fluid is generally transferred from a production/storage/transfer unit to a loading buoy mounted at a distance from the production/storage/transfer unit. By having a loading buoy, either parts thereof or the mooring thereof can be implemented in such a manner that the loading/unloading vessel can be moored to the loading buoy independently of the weather direction, thus providing a longer uptime for the loading/unloading system. The use of such a loading buoy also provides greater safety since the loading/unloading point is located at a distance from, for example, the production equipment.

At greater depths these loading buoys are arranged floating in the body of water and the motion characteristic of the loading buoy has been shown to be crucial for both uptime as well as for the service life of the loading buoy and its associated systems corresponding to those for the wellhead platforms. Such loading buoys will normally be in the form of a cylinder with a substantially vertical axis, where the diameter of the cylinder is normally around 23 m and its height is 8 meters, 6 meters of which composes the draught in the body of water. The buoy is normally equipped with a rotatable board on top, thus enabling the tanker to load/unload from whatever side is favourable based on the prevalent wind direction.

Between the production/storage/transfer unit and the loading buoy there will normally be a steel pipe, an SCR, for transfer of fluid that has to be loaded and/or unloaded. This steel pipe is normally suspended as a catenary or a modified catenary (lazy wave) from the floating loading buoy, from the attachment point to the loading buoy out into the body of water. This applies particularly when the production/storage/transfer unit is also composed of a unit floating at the surface, such as a production platform or a production and storage ship.

It has generally been found to be difficult for such risers suspended as a catenary to withstand the strain from the point of view of fatigue, and this is a particular problem with large-diameter pipes. At the same time it is desirable for the transfer pipes to have a large diameter in order to obtain a rapid transfer of fluid and thereby, for example, less connection time for the loading/unloading vessel. The principal cause of this premature fatigue in the pipes has been shown to be relatively large wave-induced movements of the floating structures. These wave-induced movements are propagated to the pipe, producing dynamic stresses in the riser. The wave-induced movements are a combination of the heaving, rolling and pitching movements which together lead to stresses in the pipe that might result in fatigue fractures. By reducing one or more of the floating structures' motion components, a substantial improvement could be achieved in the fatigue characteristics of the steel riser, and thereby longer uptime for the floating structures, for example the loading buoy or the wellhead platform.

The main object of the present invention is to provide a floating structure with the most favourable movements possible in heavy seas, in such a manner that connected transfer lines of a special type, so-called Steel Catenary Risers, SCR's, can be supported in the most favourable way, thereby experiencing the least possible fatigue loading.

It is therefore an object of the present invention to provide a structure that can be employed as a floating loading buoy with an improved motion characteristic compared to existing loading buoys. It is an object to provide a loading buoy that has greater loading/unloading capacity, where this is achieved by means of, amongst other things, longer uptime and a larger pipe diameter for the transfer pipes. It is also an object to provide a floating loading buoy that is adapted to be used in connection with steel pipes of larger diameter than normal without any negative effects on the fatigue characteristics of the loading buoy system. It is also an object to provide a loading buoy that can be used in areas with heavier seas than those in which similar existing loading buoys can be employed.

It is a further object of the present invention to provide a structure than can be employed as a wellhead platform, where the need for compensating devices is substantially reduced.

A floating structure has been provided according to the attached claims, which fulfils the above-mentioned objects.

As indicated, the structure according to the invention can be used for several purposes. The most obvious is its use as a loading buoy as described below, but another advantageous area of application will be as a wellhead platform for areas with relatively favourable sea and wave conditions.

The present invention relates to a floating structure for use as, for example, a loading buoy or a wellhead platform, comprising a surface element, columns connecting the surface element to a submerged pontoon element, mooring devices for securing the structure to the seabed, at least one attachment point for transfer pipelines to and from the floating structure. For a loading buoy the structure comprises at least transfer lines from a production/processing/storage unit to the loading buoy and mooring and transfer devices for transferring fluid from the loading buoy to a loading/unloading vessel. For use as a wellhead platform the structure comprises an attachment and wellhead arrangement for risers from the seabed up to the platform and at least some processing equipment.

According to the invention the surface element is arranged floating in the water plane surface. In a substantially horizontal plane the surface element has a substantially rounded cross section, and may, for example, have an external shape corresponding to a cylinder with a substantially vertical axis. The surface element may instead be envisaged as octagonal, polygonal or of some other shape, the essential thing being that it has a substantially equal load from all sides of any external stresses and thereby attempts to lie still and not rotate in the body of water on account of these external stresses. The surface element has a vertical height and a part thereof is arranged down in the body of water, forming a draught of the surface element. The surface element might be designed as a cylindrical annular element, i.e. with a through-going opening in the centre along a substantially vertical symmetry axis, in the manner of a moon pool.

A plurality of columns extends from the surface element down to the pontoon element. The number of columns may be varied. The columns may have a substantially cylindrical shape, but may also be designed in different shapes, such as square or polygonal. Columns may also be envisaged in the form of trusswork. The essential thing here is not the actual shape of the columns but the fact that they have a shape that has little influence on the loading buoy's motion characteristic and that they transmit the necessary forces between the surface element and the pontoon element.

Like the surface element, the pontoon element also has a substantially rounded external perimeter in a substantially horizontal plane, thus forming a substantially cylindrical external perimeter of the pontoon element in the vertical direction. By this we mean everything from an equilateral polygonal external perimeter such as, for example, an octagonal or sixteen-sided perimeter to a circular external perimeter. Other variants of the pontoon may also be envisaged, but these are not so advantageous. The pontoon element has a volume and a draught in the body of water. The pontoon element may well be designed as an annular pontoon element with a substantially vertical symmetry axis and thereby with an internal through-going opening corresponding to a moon pool, but a cylindrical pontoon element may also be envisaged with a substantially vertical axis coincident with the surface element's vertical axis without a through-going opening.

The system for mooring the structure to the seabed is a so-called rigid mooring system extending from the structure to anchor devices on the seabed. The choice of attachment system of the mooring system to the structure and to the seabed will be up to a skilled person to decide, but a variant may be envisaged, for example, where the mooring lines extend from the outer side of the surface element with a slanting orientation down to the seabed. Different mooring devices may also be envisaged here for a loading buoy as compared to a wellhead platform.

In order to achieve the advantageous motion characteristic, the floating structure according to the invention is designed according to the following criteria, which have been shown to be advantageous, where the deduction thereof will be explained below in the detailed part of the description. A first criterion is that the proportion of the volume of the pontoon element divided by the waterline area of the surface element is in the range 4-12 and preferably approximately 6 for the loading buoy, but may be in the range 6 to 12 for the wellhead platform, preferably in the range 10-12. A second criterion is that the draught of the surface element divided by the draught of the pontoon element is in the range 0.30-0.5 and preferably 0.3-0.4 for the loading buoy and preferably 0.4-0.5 for other applications such as, e.g., the wellhead platform. A final criterion is that the vertical mooring rigidity for the structure is in the range 20-75% for the floating structure according to the invention and preferably 50-75% for a loading buoy but in the range 20-50% for a wellhead platform in relation to the waterline rigidity ($\rho gWa$) where $\rho$ is the density of water, g is the gravitational acceleration and Wa is the water plane area.

The fact that this floating structure provides particularly good support conditions for an SCR-type steel riser can also be exploited in different areas of application. One example of this is a loading buoy and another is a wellhead platform for areas with favourable wave conditions, such as for example the west coast of Africa. A wellhead platform may be a floating structure, whose external features are fairly similar to a loading buoy, although generally slightly larger and with a number of other functions. The wellhead platform will be connected to the hydrocarbon reservoir by means of rigid vertical risers. The so-called wellheads, which are valves that regulate the oil flow, are located on the actual platform, as opposed to so-called sub-sea solutions where the wellhead valves are located in structures on the seabed.

A wellhead platform will often be an economically favourable alternative to sub-sea solutions, but it requires the motion to be compensated by suitable mechanical equipment on the platform deck. Consequently the platform's motion must be as favourable as possible in relation to the existing wave conditions at the field.

Once the hydrocarbon flow has reached the deck of the wellhead platform, it is often subjected to a certain amount of processing before being sent on to a total production plant. This production plant may be another platform, a production ship or the hydrocarbon flow is sent ashore via pipelines. At all events the hydrocarbon flow will be exported via an SCR-type steel riser. Consequently in this case the benefits will be enjoyed of the platform's favourable motion both for attaching the steel riser and for the arrangement of heave compensation of the wellheads on the top of the rigid wellhead risers.

The second area of application for the floating structure according to the invention is as a loading buoy. Transfer pipelines from the loading buoy to a production/processing/storage unit and/or to the loading/unloading unit extend approximately as catenaries of normally rigid pipes, for example SCR's, from the loading buoy. In most cases, moreover, the production/processing/storage unit consists of a second floating unit. Other variants may be envisaged with catenary transfer from a seabed or well-based production unit, a storage arrangement on shore or a fixed platform structure, and thus the invention will not be limited to only include loading buoys where the transfer pipelines extend from a floating unit to the loading buoy. The transfer pipelines may also be envisaged extending over/through a buoyancy element that is submerged or located on the surface of the water, the pipes thereby forming an approximate catenary in towards the loading buoy.

In a preferred embodiment of the floating structure the columns exert little influence on the structure's pattern of movement, being composed of either trusswork, completely or partly closed elements, preferably in cylindrical form with a small average diameter, polygonal, equilateral, other shapes and/or a combination thereof. In some embodiments of the invention the columns may completely or partly form buoyancy elements in order to increase the buoyancy of the structure.

In order to provide optimal uptime for the floating structure when it is used as a loading buoy, in a preferred embodiment the surface unit comprises a rotatable deck element for varying orientation of mooring and transfer devices for transferring fluid.

In a preferred embodiment of the floating structure the surface element has a proportion of draught divided by total height approximately equal to 0.75 and the surface element has a substantially cylindrical shape with a centre axis substantially vertically oriented, and a through-going central opening similar to a moon pool through both the surface element and the pontoon element.

Furthermore, the pontoon element is composed of an annular pontoon, e.g. octagonal with an external average diameter. In a preferred embodiment the proportion of the diameter of the surface element divided by the external diameter of the annular pontoon is approximately equal to 0.7.

The invention will now be explained in greater detail with an explanation of an embodiment in the form of a loading buoy and the theoretical deduction of the invention, with reference to the attached drawings. This embodiment should not be considered as limiting the invention to a loading buoy, since it can equally well be employed as a wellhead platform. The attached drawings are as follows:

FIG. 1 is a view of a loading buoy according to the invention used between a floating production/storage unit and a loading/unloading vessel.

FIG. 1*a* is a cross sectional view of the loading buoy according to an embodiment of the invention.

FIG. 1*b* is the embodiment in FIG. 1*a* viewed from above.

Figure 1:
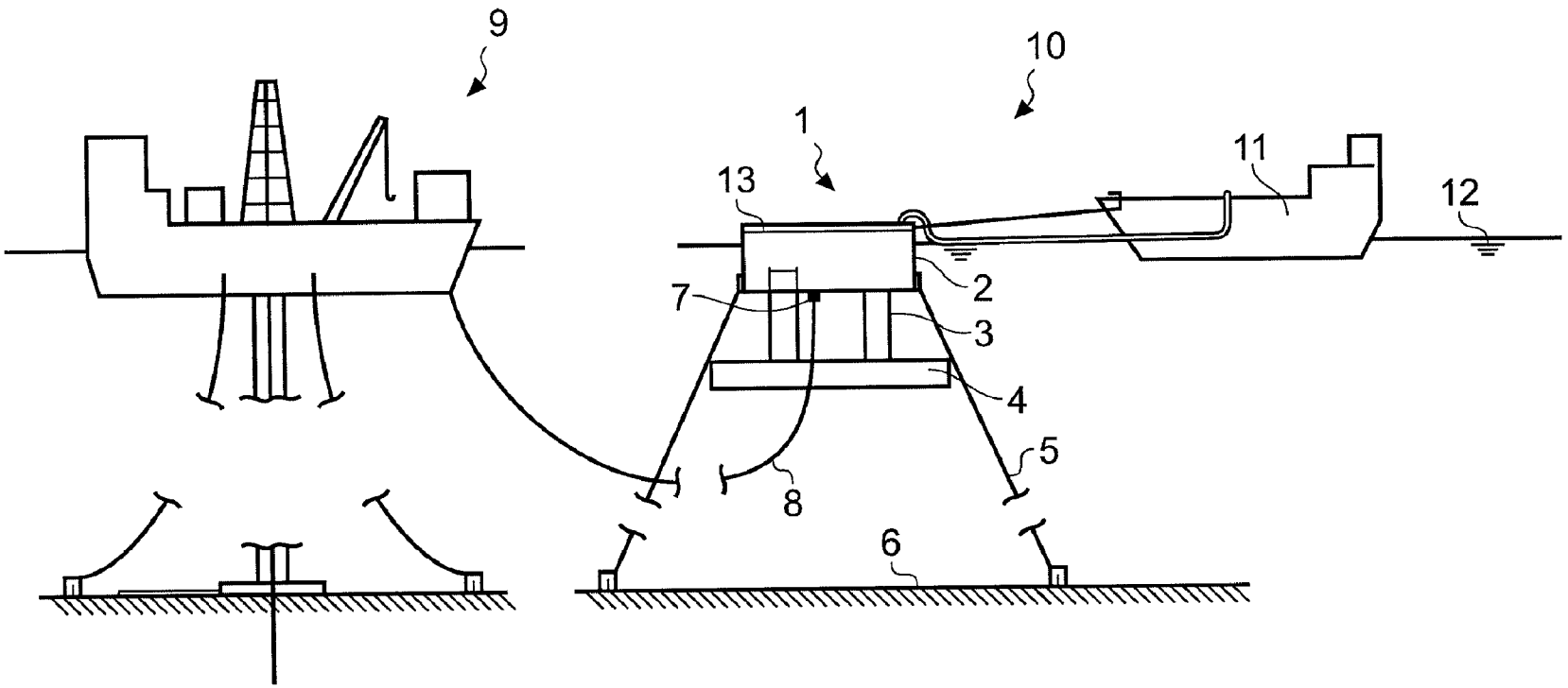

An embodiment of the loading buoy according to the invention is illustrated in FIG. 1. It should be noted that the elements in the figure are not shown in the correct scale in relation to one another. The loading buoy 1 comprises a surface element 2 that floats on the surface of the water 12. Columns 3 extend from the surface element down to a pontoon element 4. The loading buoy 1 is moored by a so-called rigid mooring system 5 to the seabed 6.

The mooring system 5 is illustrated with mooring lines extending from the outside of the surface element at an oblique angle down to the seabed 6. The angle of the mooring lines is such that they clear the pontoon and in many cases will be in the range around 30 degrees with a vertical axis. Other variants of mooring may be envisaged, for example where the mooring lines are passed in guide devices on the pontoon element.

From an attachment point 7 on the loading buoy 1 a transfer pipeline 8 extends to the production/storage unit 9, which in this case is a floating production/storage ship. Since this unit 9 is not a part of the invention it is not described further. Only one pipe 8 is shown, but several parallel pipes may also be envisaged. In connection with a mooring and transfer system 10 hoses extend from the loading buoy 1 for transfer of fluid between the loading buoy 1 and a loading/unloading vessel 11. The mooring and transfer system 10 is preferably mounted on a swivel 13 which forms part of the surface element 2. In this case the mooring and transfer system 10 is composed of a flexible hose floating in the surface of the water that is passed up to the vessel amidships. Other variants may of course be envisaged here, such as a submerged buoy, telescopic transfer boom, etc.

Figure 1A:
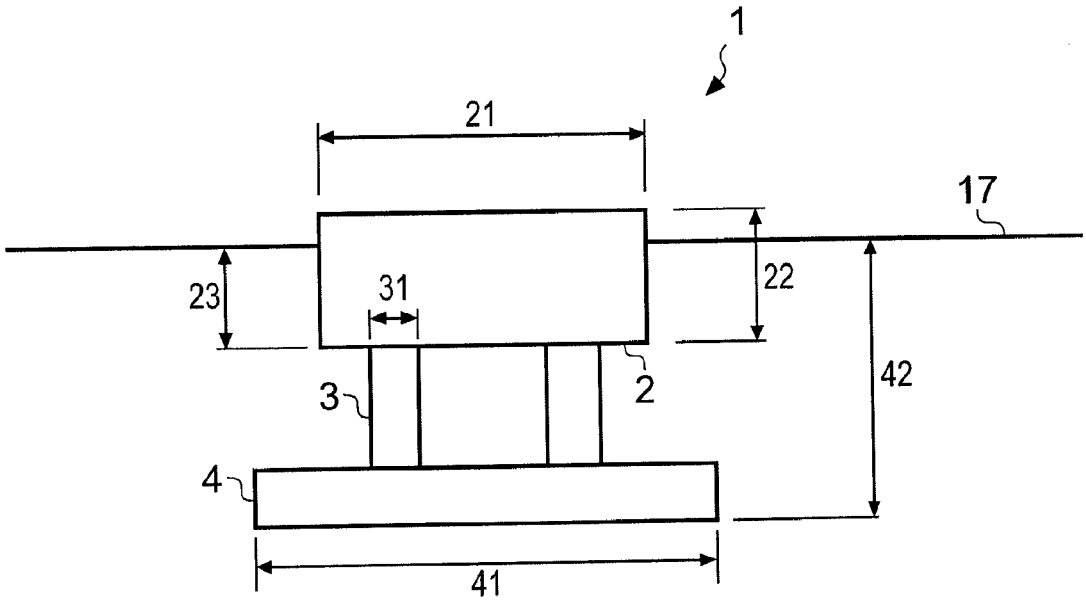
Figure 1B:
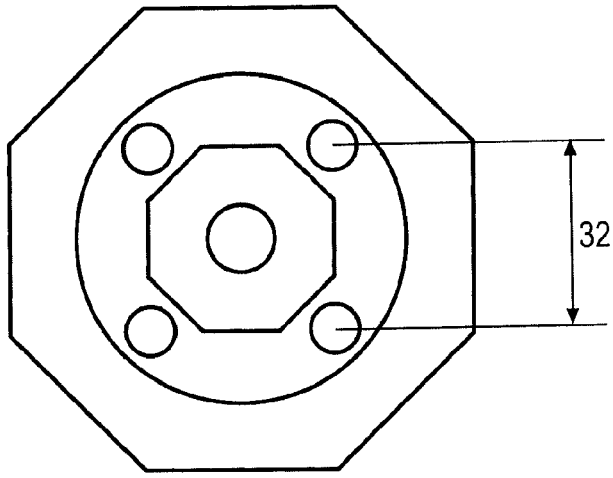

In FIGS. 1*a* and 1*b* the constructional elements of the loading buoy 1 are shown in more detail. The loading buoy 1 has a surface element 2, which is arranged floating in the surface of the water 12. In this embodiment the surface element has a substantially cylindrical annular shape with a substantially vertical axis. The surface element 2 has a diameter 21 and a height 22 in the vertical direction plus a draught 23 down in the body of water under the surface 12. Four columns 3 extend from the bottom of the surface element 2 down to the pontoon element 4. The columns 3 have a column diameter 31 and a distance 32 between the centre axis and the columns. The pontoon 4 in this case is an octagonal annular pontoon 4 with a diameter 41 and a draught 42 down in the body of water under the surface 12.

In an embodiment of a loading buoy according to the invention the dimensions of the loading buoy in the last column in the table correspond to the values for an embodiment of the invention as a wellhead platform:

| Unit | Number reference | Value Loading buoy | Wellhead Platform |
|---|---|---|---|
| Diameter surface unit | 21 | 20 | 43 |
| Height surface unit | 22 | 8 | 12 |
| Draught surface unit | 23 | 6 | 8 |
| Diameter columns | 31 | 3 | 3 |
| Centre distance between columns | 32 | 11 | 26 |
| Diameter pontoon | 41 | 28 | 59 |
| Draught pontoon | 42 | 17 | 17 |

There now follows a theoretical deduction of the thought process behind the above-mentioned design of the loading buoy according to the invention.

A body moving in waves will be subjected to varying pressure forces over its surface. If these pressure forces are integrated, varying global driving forces are obtained for the wave-induced movements. The presence of the body in the water will disturb the ideal pressure pattern in the waves on account of reflection and diffraction. The effect of this is included by adjusting the total mass that apparently accompanies the movement; the so-called "added mass". On submerged parts of the structure it is often advantageous to consider particle accelerations acting on the displaced liquid mass by a body, including additional mass rather than integrating the pressure from the diffracted pressure potential (the Morrison method).

If we take a loading buoy according to the invention as indicated in FIG. 1 and consider it, it can be said in a rather simplified manner that the part of the body floating on the surface is subjected to pressure forces, while the underwater pontoon is subjected to mass forces.

Based on such a consideration, it can be said for the present invention that the pressure forces on the surface part will give a vertically directed pressure force, which is 180 degrees phase-shifted in relation to the forces due to the underwater part, and is essentially due to particle acceleration in the liquid. These two components that are obtained with a loading buoy according to the invention will consequently have a tendency to eliminate each other. Attempts can now be made to design the parts in the surface of the water and under the surface in such a manner that the opposing forces eliminate each other to the greatest possible extent, preferably most in an area with wave periods that are important for fatigue of steel risers.

In order to achieve this there should be specific ratios between the cross-sectional area of the buoy in the waterline, the volume of the underwater part and the draught of both.

Figure 2:
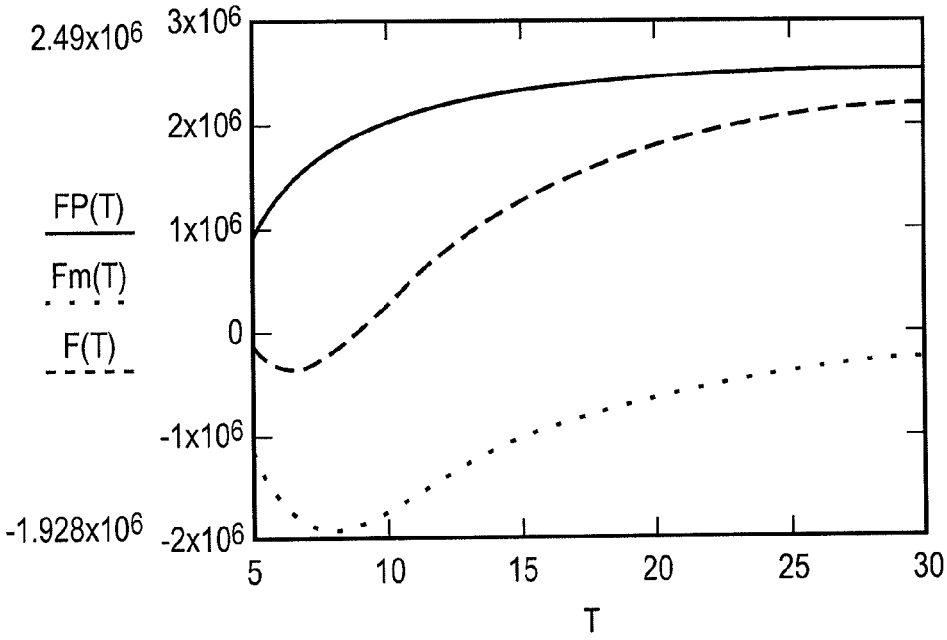
FIG. 2 is a diagram of forces in the vertical direction acting on the loading buoy according to the invention in relation to wave periods.

FIG. 2 illustrates how these forces typically can be in relation to each other in a given configuration. The unbroken line is the force due to the pressure under the bottom of the surface part alone, the dotted line is the mass forces acting on the pontoon, and the broken line is the sum of these two. As can be seen, these two forces will cancel each other out completely for a period of around 8-10 seconds, and the resultant will generally be much less for all periods.

The resulting heaving motion will consequently be substantially more favourable for the buoy with the structure and the chosen conditions according to the invention than for a buoy that only floats on the surface.

Figure 3:
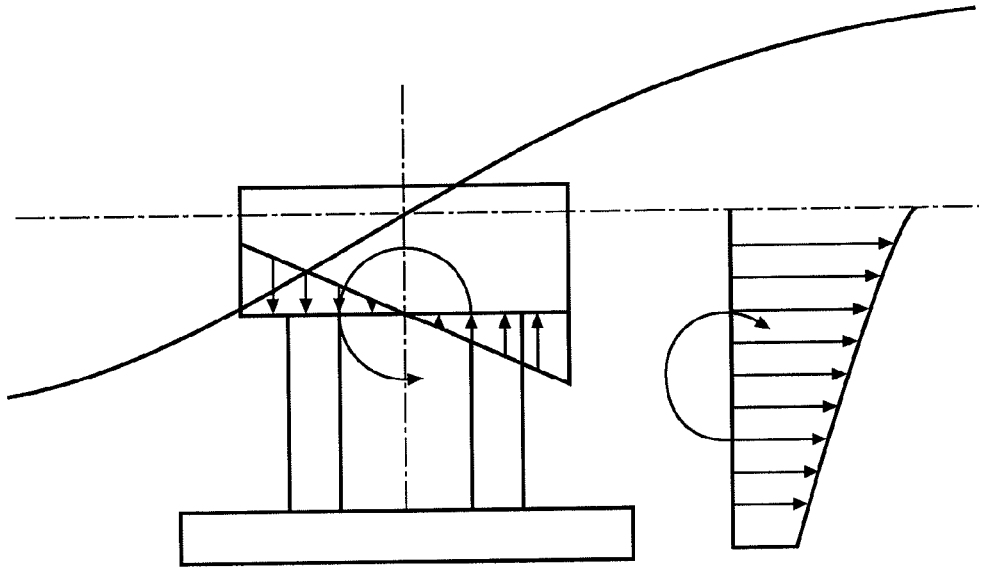
FIG. 3 is a view that attempts to show the influence of pressure forces and particle accelerations in a wave profile on a loading buoy according to the invention.

The chosen configuration is also shown to be extremely favourable with regard to the rolling and pitching movements. This effect can also be explained by the difference between pressure forces and particle accelerations in a wave profile. We have tried to illustrate this in FIG. 3.

For a wave as indicated in the figure, pressure forces, which are dominant for the buoy in the surface, result in a moment with an anticlockwise direction. The horizontal acceleration forces, however, will act in the opposite direction on account of the decreasing value of the acceleration downwards in the water depth (known as the Smith effect).

Figure 4:
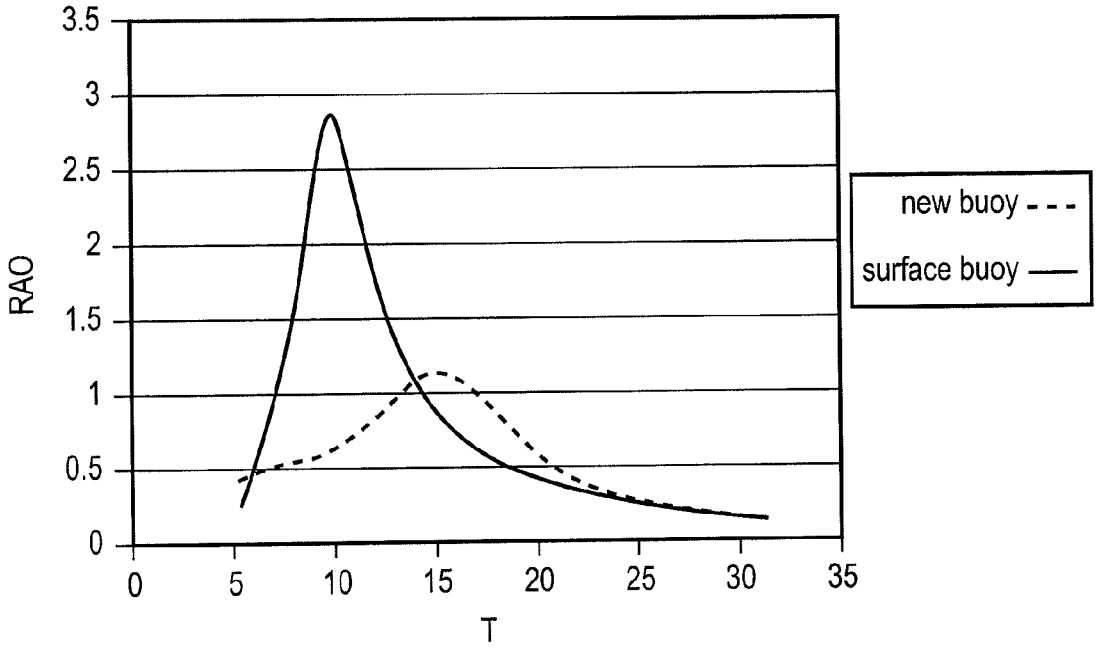
FIG. 4 is a diagram with the response operator for rolling/pitching motion in relation to wave periods for a loading buoy according to the invention.

FIG. 4 illustrates the substantial improvement in the rolling and pitching motion that is achieved by this constructional alteration according to the invention, represented by the response operator for the rolling/pitching motion.

The third method employed in order to improve the motion characteristics for the loading buoy according to the invention is to have an interaction between the mooring system and the hydrodynamic forces acting on the structure.

Every floating structure that intersects the waterline has a so-called waterline rigidity. Together with the structure's total mass this defines the natural period of the structure during heaving motion. If the unit is subjected to wave excitation with period content that is close to this natural period, this could result in very large fluctuations.

It can be proved that the natural period for a floating structure will always be higher than the cancellation period due to interaction between mass and pressure forces as discussed above.

By adding an extra external rigidity, however, it is possible to lower the natural period. If it is lowered sufficiently to coincide with the cancellation period, almost no wave excitation will occur at the natural period and no substantial movements will occur even though there is a great deal of wave excitation energy at the natural period.

In order to achieve this effect the vertical rigidity of the mooring system should be greater than 25% of the waterline rigidity, preferably greater than 50% but most preferred greater than 75% of the waterline rigidity. The choice of mooring rigidity could affect the optimal choice of dimensions for the surface part and the pontoon part.

Figure 5:
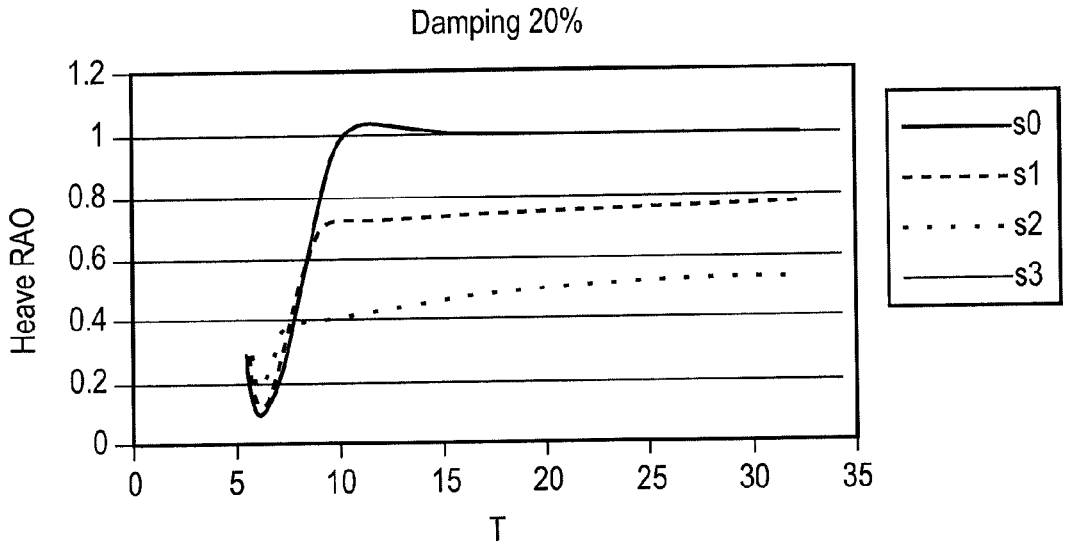
FIG. 5 is a diagram with the heave operator in relation to wave periods with the influence of the mooring rigidity for a loading buoy according to the invention.

The correlation between the motion operator for the heaving motion and vertical rigidity of the mooring system is illustrated in FIG. 5.

The invention has now been explained by means of an embodiment, which is only intended as an example, and a number of variants and alterations can be envisaged in relation thereto which are within the scope of the invention as defined in the following claims. For example, the surface element may be octagonal or polygonal. The pontoon element may be envisaged as cylindrical and without a moon pool. The columns may be conical in shape with a lower trusswork part, etc.

The invention claimed is:

1. A floating structure in the form of a loading buoy or wellhead platform, the floating structure comprising:

a surface element with a substantially rounded cross section in a substantially horizontal plane, the surface element being arranged floating in the water plane surface with a draught in the body of water, columns connecting the surface element to a submerged pontoon element which, in a substantially horizontal plane, has a substantially rounded external perimeter and a draught in the body of water, mooring devices securing the floating structure to the seabed, and at least one attachment point for transfer pipelines to a second unit, wherein the proportion of the volume of the pontoon element divided by the waterline area of the surface element is in the range 4-12 [$m^3/m^2$], the draught of the surface element divided by the draught of the pontoon element is in the range 0.3-0.5 and the mooring devices have a vertical mooring rigidity in the range 20-75% of the waterline rigidity for the surface element.

2. A floating structure according to claim 1, wherein the floating structure is a loading buoy and the proportion of the volume of the pontoon element divided by the waterline area of the surface element is in the range 4-7 [$m^3/m^2$], and the draught of the surface element divided by the draught of the pontoon element is in the range 0.31-0.43 and where the mooring devices have a vertical mooring rigidity which is over 50% of the water plane rigidity for the surface element.

3. A floating structure according to claim 1, wherein the floating structure is a loading buoy and the proportion of the volume of the pontoon element divided by the waterline area of the surface element is approximately 6 [$m^3/m^2$], and the draught of the surface element divided by the draught of the pontoon element is in the range 0.31-0.43 and where the mooring devices have a vertical mooring rigidity which is over 50% of the water plane rigidity for the surface element.

4. A floating structure according to claim 2 or 3, wherein the transfer pipeline from the loading buoy to the production/processing/storage vessel and the loading/unloading unit extends as catenaries from the loading buoy.

5. A floating structure according to claim 2 or 3, wherein the transfer pipeline from the loading buoy to the production/processing/storage vessel or the loading/unloading unit extends as catenaries from the loading buoy.

6. A floating structure according to claim 1, wherein the surface unit comprises a rotatable deck element for varying orientation of mooring and transfer devices for transfer of fluid.

7. A floating structure according to claim 1, wherein the columns at least partly form buoyancy elements.

8. A floating structure according to claim 1, wherein the surface element has a substantially cylindrical shape or alternatively an annular shape with a centre axis substantially vertically oriented.

9. A floating structure according to claim 1, wherein the pontoon element is composed of an octagonal annular pontoon with an outer average diameter.

10. A floating structure according to claim 1, 2, 3 or 8, wherein the pontoon element is composed of an octagonal annular pontoon with an outer average diameter and the proportion between a diameter of the surface element divided by the average diameter of the annular pontoon is in the range 0.7.

11. A floating structure according to claim 1, wherein the proportion of the surface element's draft to its total height is approximately equal to 0.75.

* * * * *